United States Patent [19]

Lee

[11] 4,057,167

[45] Nov. 8, 1977

[54] VALVED RECEPTACLE CLOSURE

[76] Inventor: Jin Ku Lee, 8108 Gorman Ave., No. 229, Laurel, Md. 20810

[21] Appl. No.: 746,604

[22] Filed: Dec. 1, 1976

[51] Int. Cl.[2] ..... A47G 19/22; B65D 51/18; B65D 43/20

[52] U.S. Cl. ..... 220/90.4; 222/559; 220/254; 220/348

[58] Field of Search ..... 220/90.4, 254, 361, 220/367, 345, 346, 348; 229/7 R; 222/511, 559, 561, 570

[56] References Cited

U.S. PATENT DOCUMENTS

| | | | |
|---|---|---|---|
| 2,251,392 | 8/1941 | Bernhardt | 222/559 X |
| 2,433,142 | 12/1947 | Moen | 220/348 |
| 2,578,201 | 12/1951 | Nicorvo | 220/90.4 X |
| 2,622,420 | 12/1952 | Rice | 222/559 X |
| 2,884,157 | 4/1959 | Lampkin | 220/90.4 X |
| 3,412,892 | 11/1968 | Waksman et al. | 220/90.4 |
| 3,938,690 | 2/1976 | Butler | 220/254 X |

*Primary Examiner*—William Price
*Assistant Examiner*—Steven M. Pollard
*Attorney, Agent, or Firm*—Wigman & Cohen

[57] ABSTRACT

A valved closure for a disposable drinking receptacle containing a consumable beverage is disclosed. The valved receptacle closure comprises a thin plastic cover having a peripheral groove adapted to sealingly engage with the rim of a drinking receptacle and a drinking opening therein through which the beverage is consumed. A slide valve is received in a recess formed in the cover and is movable into a closed position over the drinking opening. A releasable latch mechanism cooperates with the valve to secure the valve in its closed position against the force of a resilient member, such as a spring. When the latch is released, the resilient member urges the valve into its open position exposing the drinking opening to permit drinking therefrom.

15 Claims, 9 Drawing Figures

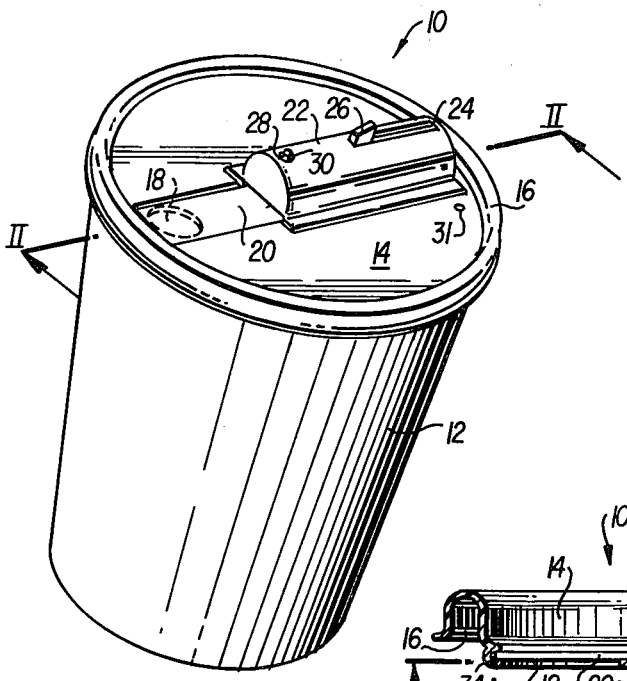
FIG. 1
FIG. 2
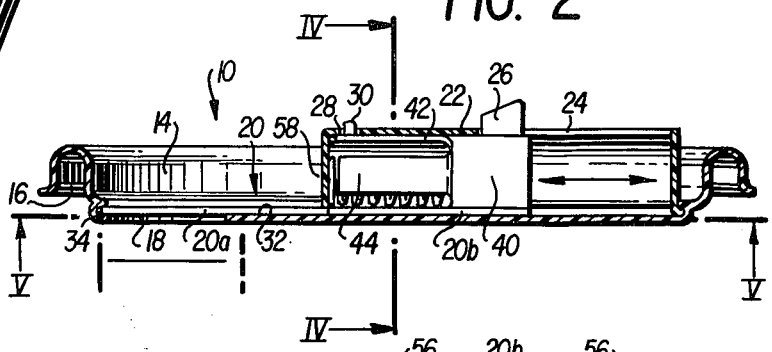
FIG. 5
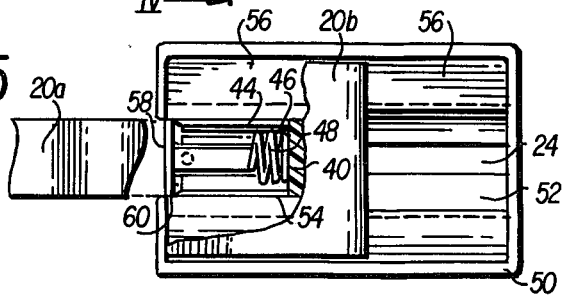
FIG. 4
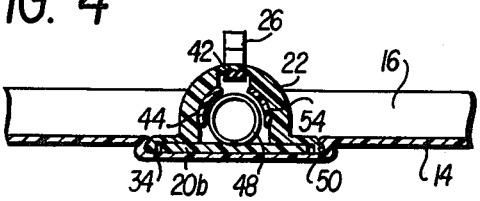
FIG. 3
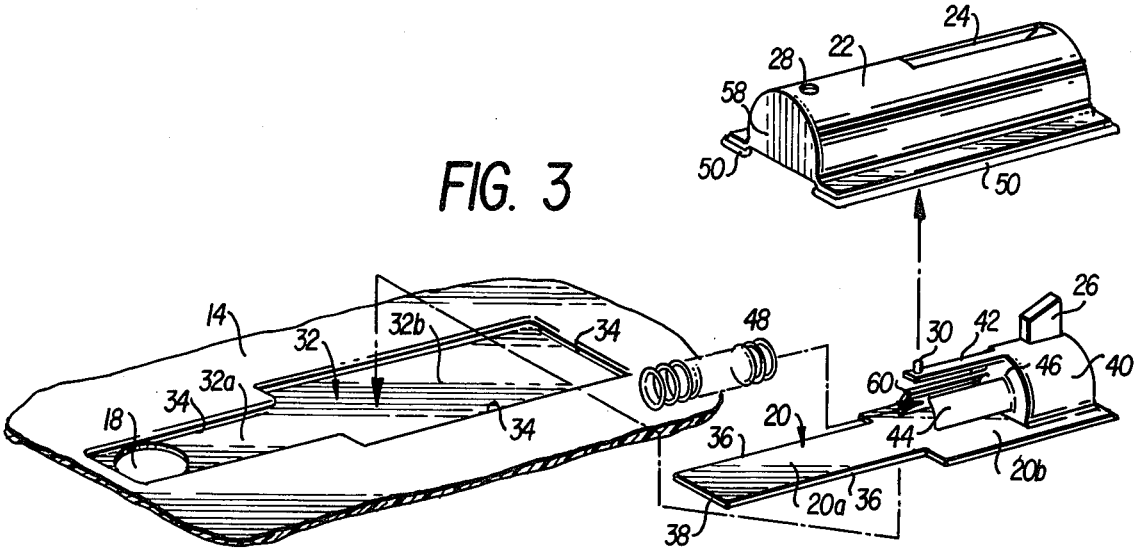

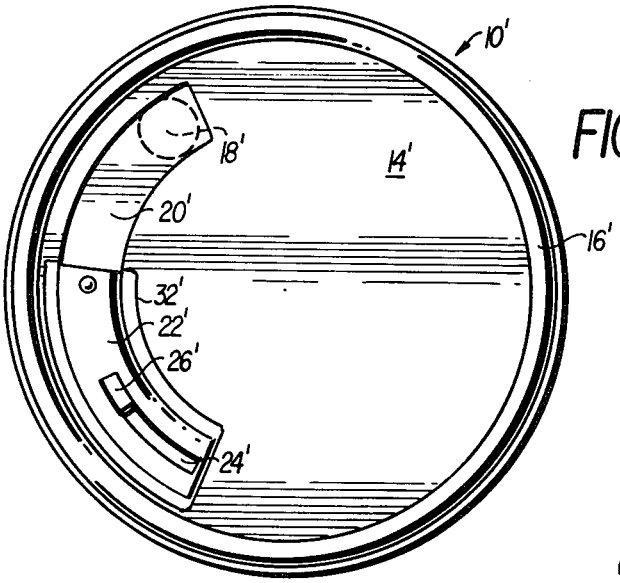
FIG. 6
FIG. 9
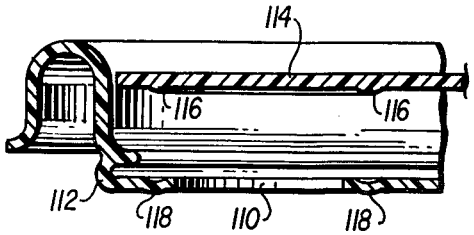
FIG. 7
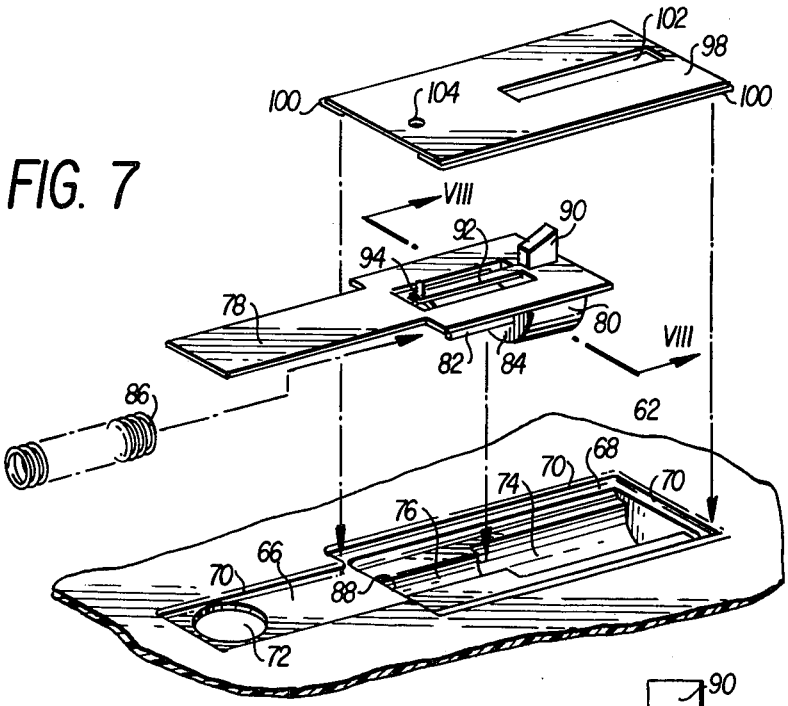
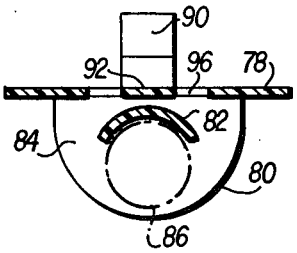
FIG. 8

VALVED RECEPTACLE CLOSURE

BACKGROUND OF THE INVENTION

The present invention relates generally to a closure for drinking receptacles and more particularly to a resiliently biased valve closure for use with a drinking receptacle during intermittent drinking of hot or cold beverages therefrom.

Beverages, such as hot coffee or tea, cold carbonated drinks, beer and the like, are often provided in throw-away or disposable drinking receptacles having substantially impermeable rim-engaging closures which prevent spillage of the beverage and aid in maintaining the temperature of the beverage, whether hot or cold. Such disposable drinking receptacles and closures therefor are typically found in or used in connection with vending machines, business establishements offering carry-out beverage services, to so-called "fast food" restaurants, offices, factories and in many other places where beverages are sold or otherwise provided. Frequently, the consumer will drink intermittently from the receptacle while engaged in other tasks, for example, when he is driving or riding in a vehicle or working at his place of employment. In such situations, the prior art closures for disposable drinking receptacles are generally discarded, in the case of hot beverages and, in the case of cold beverages, a drinking straw is often inserted into a knock-out opening provided in the closure. In either case, however, the likelihood of spillage of the beverage is substantially increased and maintenance of the beverage temperature, particularly hot beverages if the closure is discarded, is adversely affected.

Generally speaking, valve closures for receptacles containing consumable liquids are known in the art, as are the problems associated with maintaining the temperature of the beverages contained in the receptacles. Typical examples of known valved closures are discloed in the following U.S. Patents which were uncovered by a search of the prior art:

U.S. Pat. Nos. 1,066,813; 1,327,389; 1,412,330; 1,592,362; 2,274,844; 2,701,078; 2,780,395; 2,826,345; 2,961,133; 3,059,817; 3,341,088; 3,343,709; 3,871,522; 3,967,748.

The prior art devices described in the patents listed above, as well as other prior art receptable closures have not been completely responsive to the above-discussed problems. In particular, many of the known devices are of rather complex design and, therefore, comparatively expensive construction. Moreover, partly because of their costly construction, these prior art closure devices are notably unsuited for use with disposable drinking receptacles.

U.S. Pat. No. 3,967,748, for example, discloses one type of valved closure used in connection with a thermally insulated double-walled container for hot or cold beverages. The valve closure comprises a cover having a drinking opening therein and a spring-biased valve with an O-ring seat operable by depressing and holding a spring-biased, finger-operated plunger to open the valve and permit drinking from the opening. One difficulty with this device is that the valve must be maintained open by constant finger pressure applied to the plunger which is disadvantageously located well above the center of gravity of the liquid-filled receptacle thus making drinking from the receptacle with only one hand more difficult and awkward. Another disadvantage of this device is that the valving mechanism is positioned on the inner surface of the closure such that it will be at least partly immersed in the beverage when the container is tilted for drinking. Thus, a thorough cleaning of the valve mechanism must be performed for sanitary reasons before the closure can be reused. In addition, this device includes a large number of complex parts, some of which are assembled together by press fitting or cementing so that the valve mechamism cannot be readily disassembled for cleaning.

SUMMARY AND OBJECTS OF THE INVENTION

In view of the foregoing disadvantages and shortcomings of the prior art devices, it should be apparent that there still exists a need for a valved closure usable particularly with a disposable drinking receptacle and which is of simple, inexpensive construction and readily assembled and disassembled. It is, therefore, a primary object of the present invention to fulfill this need by providing a novel valved cover for disposable drinking receptacles having a minimum number of components, preferably molded of polymer materials.

More particularly, it is an object of the present invention to provide a drinking receptacle cover adapted to sealingly engage the open end or rim of a receptacle and having a resiliently biased closure valve which is mounted in and guided by a recess formed in the upper surface of the cover.

Still more particularly, it is an object of the present invention to provide a slide valve for a drinking receptacle cover which has a latch mechanism for securing the slide valve in its closed position against the force of a resilient member.

It is another object of this invention to provide an economical valved cover for a drinking receptacle which may be either disposed of or reused by the consumer as desired.

Another object of this invention is to provide a valved cover for a drinking receptacle having interlocking components which can be readily assembled and disassembled by the user without the need for fastening devices, adhesives, special assembly tools, procedures or equipment.

Still another object of the present invention is to provide a valved drinking receptacle cover having a valve operator mechanism which, during use, is not immersed in or contacted by the liquid contained in the receptacle.

Yet another object of the invention is to provide a drinking receptacle cover having a closure valve and closure latch mechanism both of which are selectively and conveniently actuable by the index finger of the operator's hand in which the drinking receptacle is held.

Another important object of the invention is to provide an economical valved cover for disposable drinking receptacles including, but not limited to, drinking cups formed of paper or synthetic plastic materials and metal cans, such as those used to contain carbonated beverages, beer and the like.

Briefly described, these and other objects of the invention are accomplished by providing a valved closure for a drinking receptacle comprising a cover formed by conventional molding techniques and equipment, preferably of a thin plastic sheet material of substantially uniform thickness, and having a peripheral groove or recess for sealingly engaging the rim of the drinking receptacle. In one embodiment, the cover is formed with an elongate, diametrically arranged recess of uniform shallow depth on the side of the cover opposite the rim-engaging groove. The recess includes a narrow portion and a wide portion and is formed with slightly overhanging edges or kerf-like grooves therearound. An opening is provided through the cover material at one end of the narrow portion of the recess adjacent the rim-engaging groove and through which the liquid contained in the receptacle is adapted to be consumed. A flat closure valve, which also has narrow and wide portions, is adapted to be received in the recess with its narrow portion slidably engaging in the grooves of the narrow portion of the recess. The closure valve is diametrically movable to selectively cover or expose the drinking opening.

The wide portion of the closure valve slides in the corresponding wide portion of the recess with its longitudinal edges in spaced relation to the kerf-like grooves of the wide recess portion. Mounted to the upper surface of the wide portion of the closure valve and integrally formed therewith is an embossment which supports at its upper end an upstanding handle and a resilient latch member, both of which are finger-actuable. A pair of arcuate arms are mounted to one side of the embossment and extend horizontally therefrom for retaining a resilient member, such as a coil spring or the like. The handle, latch and arcuate arms are also integrally formed with the embossment and closure valve, preferably of a polymer material, by conventional injection or other molding techniques.

A generally semi-cylindrical retaining housing, also formed of a polymer material and having closed ends is fitted over the embossment and wide portion of the closure valve. The housing is provided with flange-like lips which interlockingly engage with the undercut edges or grooves of the wide portion of the recess to retain the closure valve in position. An elongate longitudinal slot is provided through the upper wall surface of the housing from one end thereof to approximately the mid-point thereof and in which the handle is longitudinally movable. Aligned with the slot and located at the opposite end of the housing is a latch opening in which the latch member engages. In the described embodiment, the resilient spring is disposed between one side of the embossment and one end of the housing in such manner that the closure valve is urged into a position whereby the drinking opening is exposed. This arrangement facilitates operation of the valve using a finger of the hand in which the drinking receptacle is held. It will be appreciated by those skilled in the art, however, that the valve mechanism could be arranged so that the spring urges the closure valve into a normally closed condition. When engaged in the housing opening, the latch member retains the closure valve, against the force of the spring, in its closed position covering the drinking opening.

In one alternate embodiment, the recess, closure valve and its associated, integrally formed components, and the housing are arcuately shaped and are adapted to be actuated by an arcuately-applied force, but are otherwise constructed and operate in substantially the same manner as described above. In still another embodiment of the invention, the embossment and a spring retaining arm are arranged on the underside of the closure valve and are received in a semi-cylindrical recess formed longitudinally of the wide portion of the shallow recess in the receptacle cover. The semi-cylindrical recess is shaped substantially the same as the interior surface of the above-described retaining housing. The handle and latch members are arranged on the upper side of the closure valve and are held in position by a substantially flat retaining plate. The retaining plate is provided with flange-like lips which interlock with the undercut edges of the wide recess portion and has a handle-receiving slot and latch opening similar to that of the retaining housing. This latter embodiment is particularly advantageous in that the valve operator mechanism can be recessed below the receptacle cover surface to thereby present a substantially flat upper surface of the cover.

An important feature of the present invention is the construction and design of the various elements of the valved receptacle closure whereby the molded interlocking plastic parts may be readily assembled together without the need for fasteners or adhesives. This feature also makes it possible to supply the closure device either fully assembled or in kit form suitable for ready assembly by the user. In addition, the low cost of the individual parts, when manufactured in large quantities according to conventional high-production molding techniques, renders the closure device according to the invention sufficiently inexpensive that, if desired, it may be supplied as a disposable item, in connection with, for example, beverage vending machines, carry-out services or the like.

With these and other objects, advantages and features of the invention that may become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 1 is a perspective view of one embodiment of the valved receptacle closure of the invention as applied to a disposable drinking receptacle;

FIG. 2 is a cross-sectional view of the valved receptacle cover of the invention taken along line II—II of FIG. 1;

FIG. 3 is a exploded perspective view, partly broken, showing the arrangement of the components of the valved closure of the invention;

FIG. 4 is a partial cross-sectional view taken along line IV—IV of FIG. 2;

FIG. 5 is a partly broken cross-sectional view taken along line V—V of FIG. 2;

FIG. 6 is a top plan view of an alternate embodiment of the valved receptacle closure of the present invention;

FIG. 7 is an exploded perspective view, partly broken, showing the arrangement of the components of a further embodiment of the valved receptacle closure of the invention;

FIG. 8 is a cross-section view of FIG. 7 showing the embodiment of the invention taken along line VIII—VIII; and FIG. 9 is a fragmentary cross-sectional detail of a modification of the invention showing the mating surfaces of the cover and closure valve.

DETAILED DESCRIPTION OF PREFERRED EMBODIMENTS

Referring now in detail to the drawings, there is illustrated in FIGS. 1–5 one embodiment of a valved receptacle closure according to the present invention as employed with a conventional disposable drinking receptacle. Like elements are given like reference numerals throughout the several views. In FIG. 1, there is shown the closure, designated generally by reference numeral 10, in engagement with a disposable cup 12, such as a conventional plastic cup, paper cup or the like, having a generally rounded upper edge or rim (not shown).

Closure 10 comprises a cover 14 having, for example, a U-shaped peripheral groove 16 which engages in substantial sealing relation with the rim of cup 12. The illustrated configuration of the peripheral groove 16 is not, however, an essential part of the present invention, it being understood that other rim engaging and sealing structures could be similarly utilized. The cover 14 is formed preferably by well-known hot- or vacuum-forming techniques from a thin, polymeric material of substantially uniform thickness, although it will be appreciated that the thickness of the cover material may vary to some extent after being formed.

Adjacent the groove 16, there is provided a circular drinking opening 18 over which a slidable closure valve or plate 20 is disposed in its closed position as seen in FIG. 1. A housing 22 encloses the valve operator for closure valve 20, which operator is described in greater detail hereinbelow. The upper portion of housing 22 is provided with an elongate slot 24 through which the valve operator handle 26 extends and an opening 28 in which a resiliently mounted latch member 30 engages. Both the handle 26 and latch member 30 are arranged so as to be easily and conveniently actuable by the index finger of the user's hand in which the cup 12 is held. A small vent opening 31 may be provided in cover 14 to relieve any vacuum created in the closed cup 12 as the beverage is being consumed.

Referring now to FIGS. 2–4, the circular cover 14 is provided with a shallow, planar recess 32 arranged diametrically thereof and which includes a narrow recess portion **32*a* and a wide recess portion 32*b*. The perimetrical edges of the recess 32 are formed in slight overhanging relation to the planar surface of the recess and define a kerf-like groove 32 therearound. Closure valve 20 comprises a generally flat plate having a narrow portion 20*a* and a wide portion 20*b* and is received in recess 32 so as to be movable longitudinally of the same to close and open the drinking opening 18. Valve portion 20*a* is dimensioned such that its side edges 36 and forward edge 38 engage with the corresponding grooves 34 of the narrow recess portion 32*a*. The edges of valve portion 20*b*, however, are in slightly spaced, non-engaging relation with the grooves 34 of recess portion 32*b*** for reasons which will become apparent as the description proceeds.

Integrally formed with valve 20 at the end of valve portion **20*b* is a generally semi-cylindrical embossment 40 from the top of which handle 26 extends. A resilient, cantilevered latch lever 42 extends from the top edge of embossment 40 and latch member 30 extends upwardly from the free end of lever 42. Beneath latch lever 42, embossment 40 is provided with a pair of spaced, arcuately-shaped arms 44 which extend horizontally from a face 46 of the embossment and which are adapted to retain a resilient member 48** such as a coil spring, elastomeric spring or the like.

Housing 22 is adapted to enclose embossment 40, as well as the right hand part of valve 20 as viewed in FIG. 3 and is provided about the base thereof with a perimetrical lip 50. Lip 50 interlocking engages with the grooves 34 of recess portion **32*b* in the manner as best seen in FIG. 4**.

FIGS. 4 and 5 illustrate the internal configuration of housing 22 and the manner in which the housing guides and retains the various elements of the slide valve 20. Housing 22 is provided with a semi-cylindrical cavity 52 in which embossment 40 is longitudinally guided. Forwardly of cavity 52, that is, to the left as viewed in FIG. 5, another semi-cylindrical cavity 54 of smaller radial dimension than cavity 52 is formed which confronts and guides the outer surfaces of arcuate arms 44. The top of cavity 54 is relieved to receive latch member 30 and latch lever 42 as best seen in FIG. 4. A planar guiding surface 56 is arranged about the bottom edges of cavities 52, 54 of housing 22 in guiding relation with the marginal edges of the top surface of valve portion **20*b***.

Still referring to FIG. 5, it will be seen that the opposite ends of coil spring 48 bear against face 46 of embossment 40 and the interior side of housing end wall 58, respectively, so as to normally urge the embossment 40 rearwardly in cavity 52. Arms 44 and the upper central surface of valve portion **20*b* transversely retain coil spring 48 to assure substantially axial compression thereof when embossment 40 is moved toward end wall 58 by means of the operating handle 26. Arms 44 are advantageously located below latch lever 42 to prevent the spring from interfering with the operation of the lever. The free ends of arms 44 are wedge-shaped as shown at 60 to provide optimum axial guiding of the spring 48** during compression thereof.

Operation of the valved closure of FIGS. 1–5 is as follows: After placement of the closure 10 on a beverage-filled drinking receptacle, such as cup 12, and with the closure in its closed position as illustrated in the drawings, the coil spring 48 is compressed and latch 30 is engaged in the opening 28 to maintain valve 20 in its closed position over drinking opening 18. When it is desired to consume the beverage, the cup is grasped in one hand and the latch 30 depressed by the index finger of such hand to disengage the latch from opening 28 and permit the spring 48 to urge valve 20 rearwardly and thus expose drinking opening 18. When released as described above, the top of latch 30 resiliently bears against the housing 22 at the inside top surface thereof. After drinking from the cup through opening 18, the user engages handle 26 with his index finger of the hand in which the cup is held and urges the handle toward drinking opening 18 against the force of spring 48 until latch 38 again engages in opening 28 to secure valve 20 in its closed position.

While it is possible to modify the above-described arrangement so that the spring urges the valve 20 into its normally closed condition, the illustrated arrangement is particularly advantageous since movement of the handle 26 toward the drinking opening 18 against the force of spring 48 is readily accomplished by the index finger of the hand which holds the cup. If the valve 20 were urged by the spring into its closed position, necessitating movement of the handle away from the drinking opening and against the force of the spring, it would be considerably more difficult to operate the valve with the index finger of the hand holding the cup and could even require the use of the user's other hand. This, of course, is undesirable, particularly if the user is engaged in other tasks, such as driving an automobile.

FIG. 6 illustrates an alternate embodiment of the present invention wherein the various components of the valved receptacle cover of the invention are curved, as viewed from above. In this embodiment, the closure 10′ comprises a circular cover 14′ having a rim-engaging edge 16′. The housing 22′ and slide valve 20′, together with all the corresponding components of the closure of FIGS. 1–5 are molded in curved form and arranged in an arcuate recess 32′ adjacent edge 16′. Curvilinear movement of handle 26′ in the arcuate slot 24′ functions to close drinking opening 18′.

In FIG. 7, there is illustrated another alternate embodiment of the invention comprising a cover 62 having a diametrically arranged recess 64 including a narrow recess portion 66 and a wide recess portion 68 both having kerf-like grooves 70 substantially identical to those of the recess 32 of FIGS. 1–5. A drinking opening 72 is disposed through cover 62 in one end of recess 66 adjacent the edge of the cover.

Recess 68 also includes a longitudinal cavity comprising semi-cylindrical cavities 74, 76 which generally correspond to cavities 52, 54 respectively of housing 22 as shown in FIGS. 4 and 5. A closure valve 78 is adapted to be slidably received in recess 64 in much the same manner as in the first disclosed embodiment. The valve 78 is provided on its underside with an embossment 80 having a single arcuate arm 82 extending from the upper part of the embossment face 84. Embossment 80 is received in and longitudinally guided by cavity 74. A coil spring 86 is disposed in cavity 76 and retained therein by arm 82, as best seen in FIG. 8, and is arranged to bear with its opposite ends against embossment face 84 and the forward wall 88 of cavity 76 respectively to urge the valve 78 rearwardly, or to the right as viewed in FIG. 7.

On the top surface of valve 78, a handle 90 is provided for moving the valve to its closed position against the force of spring 86. A resilient latch lever 92 having an upstanding latch 94 at the free end thereof extends forwardly from face 84 in a central cut-out 96 of valve 78 and is substantially coplanar with valve 78.

A flat retaining cover 98 is fitted over valve 78 and has flange-like lips 100 which interlockingly engage in grooves 70 of the recess portion 68. Cover 98 is provided with an elongate slot 102 and latch opening 104 through which extend the handle 90 and latch 94, respectively. Apart from the just-described details of construction, the embodiment of FIG. 7 operates in substantially the same manner as that of FIGS. 1∝5. An advantage of this embodiment is that the upper surface of cover 62 is substantially flat and none of the valve operator components, including the handle and latch, extend above the top surface of the U-shaped rim of the cover.

In FIG. 9, there is shown a cross-sectional detail of a modification of the invention which could be advantageously incorporated in any of the above-described embodiments. To guard against leakage of liquid from the receptacle through the drinking opening 110 in cover 112 and to improve the seal around such opening, valve 114 is provided on its underside with a slightly raised annular ridge 116 of a diameter somewhat larger than opening 110. Cover 112 is provided on its upper surface with a corresponding annular depression 118 which mates with ridge 116. It will be appreciated that the height of ridge 116 and depth of depression 118 must not be of such magnitude that they will engage with sufficient force to prevent opening of the valve when the latch mechanism is released.

While the above-described embodiments relate to the use of the novel receptacle closure of the invention in connection with disposable drinking cups, the invention could clearly be advantageously utilized in connection with conventional aluminum or steel cans which are opened by means of a top-penetrating utensil or by means of a so-called "flip top" opening device.

From the foregoing, it will be appreciated that the present drinking receptacle closure fulfills, in a novel way, all the aforementioned objects of the invention, as well as other objectives not specifically mentioned. Although only a preferred embodiment is specifically illustrated and described herein, it will be understood that many modifications and variations of the present invention are possible in light of the above teachings and within the purview of the appended claims without departing from the spirit and intended scope of the invention.

What I claim is:

1. A closure adapted to be mounted in a cover of a fluent material receptacle, said cover having an opening which communicates with the fluent material in the receptacle, said closure comprising valve means movable from a first position closing said opening to a second position exposing said opening, mounting means on said cover for slidably engaging said valve means with respect to said cover, resilient means for urging said valve means into said second position, and latch means operatively connected to said valve means for releasably securing said valve means in said first position against the force of said resilient means.

2. The closure according to claim 1, wherein said mounting means comprises a recess arranged diametrically of said cover for receiving said valve means therein and including grooves in said recess slidably coacting with said valve means for guiding said valve means between said first and second positions.

3. The closure according to claim 2, wherein said valve means comprises a substantially flat slide valve having longitudinal edges, said longitudinal edges slidably engaging said grooves.

4. The closure according to claim 2, wherein said cover is formed of a polymeric material of substantially uniform thickness, said recess and grooves being integrally formed in 5. The closure according to claim 1, including a handle connected to said valve means for moving said valve means into said first position, said valve means including a slide valve having an embossment on one side thereof and against which said resilient means applies a force to urge said slide valve into said second position.

6. The closure according to claim 5, wherein said handle and latch means are mounted to said valve means on the side thereof opposite said embossment, said cover having a cavity guidingly receiving said embossment for longitudinal movement therein, a retaining plate mounted to said cover over at least a portion of said valve means, said plate having a elongate slot through which said handle extends and an opening in which said cantilever member is releasably engageable.

7. The closure according to claim 5, including at least one arcuate arm connected to said embossment and cooperating with said resilient means for axially guiding said resilient means when said valve means is moved between said first and second positions.

8. The closure according to claim 5, wherein said handle and latch means are mounted to said embossment and including a housing mounted to said cover and having a cavity therein guidingly receiving said embossment for longitudinal movement therein, said housing having an elongate slot through which said handle extends and an opening in which said cantilever member is releasably engageable.

9. The closure according to claim 8, wherein said resilient means comprises a coil spring having two ends, one of said spring ends bearing against said embossment, the other of said spring ends bearing against a transverse wall of said housing.

10. The closure according to claim 1, wherein said cover is formed of a thin, polymeric material of substantially uniform thickness.

11. The closure according to claim 1, wherein said cover is generally circular, said mounting means and valve means being curved and arranged arcuately of said cover adjacent the edge thereof.

12. A valved closure for a disposable drinking receptacle comprising a cover having a peripheral edge for sealingly engaging a receptacle rim, said cover being formed of a thin synthetic plastic of substantially uniform thickness, said cover having a recess integrally formed therein, a drinking opening in said cover disposed in said recess adjacent the edge of said cover, said recess having grooves therearound, a slide valve disposed in said recess and having edges coacting with said grooves for slidable movement of said slide valve between a first position closing said drinking opening and a second position exposing said drinking opening, and resilient means operatively associated with said slide valve for urging said slide valve into said second position and latch means for releasably securing said slide valve in said first position, said latch means comprising a resilient cantilever member having a free end and connected to said slide valve, said latch means being actuable to release said slide valve by application of a linear force to the free end of said cantilever member.

13. A valved closure for a drinking receptacle having a rim comprising a cover adapted to engage the rim of the drinking receptacle, a drinking opening disposed in said cover, valve means cooperating with said cover and movable in a plane between a first position closing said opening and a second position exposing said opening, resilient means cooperating with said valve means for urging said valve means into said second position, finger-actuable means for moving said valve means into said first position against the force of said resilient means and latch means operatively connected to said valve means for releasably securing said valve means in said first position against the force of said resilient means, said latch means being releasable by a linear force applied to said latch means in a direction substantially normal to the plane of movement of said valve means.

14. A closure adapted to be mounted in a cover of a fluent material receptacle, said cover having an opening which communicates with the fluent material in the receptacle, said closure comprising valve means movable from a first position closing said opening to a second position exposing said opening, mounting means on said cover for slidably engaging said valve means with respect to said cover, resilient means for urging said valve means into one of said positions, and latch means operatively connected to said valve means for releasably securing said valve means in the other of said positions against the force of said resilient means, said latch means comprising a resilient cantilever member having a free end releasable by application of a linear force to said free end.

15. The closure according to claim 14, wherein said resilient means is arranged to urge said valve means into said second position.

* * * * *